US005601692A

United States Patent [19]

Rinker et al.

[11] Patent Number: 5,601,692

[45] Date of Patent: Feb. 11, 1997

[54] PROCESS FOR TREATING NONCAKING COAL TO FORM PASSIVATED CHAR

[75] Inventors: Franklin G. Rinker, Perrysburg; Deane A. Horne, Toledo, both of Ohio; Dennis W. Coolidge, Gillette, Wyo.; Ernest P. Esztergar, La Jolla, Calif.

[73] Assignee: Tek-Kol Partnership, LaJolla, Calif.

[21] Appl. No.: 565,851

[22] Filed: Dec. 1, 1995

[51] Int. Cl.[6] ..... C10L 9/10

[52] U.S. Cl. ..... 201/9; 44/599; 44/626; 201/28; 201/39

[58] Field of Search ..... 201/9, 28, 39; 44/492, 592, 594, 599, 608, 626

[56] References Cited

U.S. PATENT DOCUMENTS

| | | | |
|---|---|---|---|
| 2,793,109 | 5/1957 | Huebler et al. | 75/3 |
| 3,013,951 | 12/1961 | Mansfield | 202/15 |
| 3,302,936 | 2/1967 | Ban | 263/28 |
| 3,672,069 | 6/1972 | Reh et al. | 34/20 |
| 3,950,143 | 4/1976 | Pyle | 44/599 |
| 4,269,593 | 5/1981 | Faulkner et al. | 432/58 |
| 4,308,668 | 1/1982 | Ito et al. | 201/9 |
| 4,401,436 | 8/1983 | Bonnecaze | 44/1 |
| 4,521,278 | 6/1985 | Kelley et al. | 201/17 |
| 4,645,513 | 2/1987 | Kubota et al. | 44/599 |
| 4,769,042 | 9/1988 | Ito et al. | 44/626 |
| 4,834,650 | 5/1989 | Docherty et al. | 432/138 |
| 4,924,785 | 5/1990 | Schultz et al. | 110/346 |

*Primary Examiner*—Timothy McMahon

*Attorney, Agent, or Firm*—Brinks Hofer Gilson & Lione

[57] ABSTRACT

A continuous process for treating a noncaking coal to form stable char. The process includes the sequential steps of drying the coal to remove moisture therefrom and form a dry coal; pyrolyzing the dry coal by progressively heating substantially all of the coal to a temperature sufficient to vaporize and remove low end volatile materials from the coal to form char and sufficient to mobilize at least a portion of high end volatile materials within the char and at least partially collapse micropores within the char. The char is then cooled to a temperature sufficient to demobilize the volatile materials within the at least partially collapsed micropores of the char to pyrolytically passivate the char. The char is then conveyed to a reaction vessel wherein a process gas having about 3%–21% by volume oxygen flows through the reaction vessel to oxidatively passivate the coal by chemisorption of oxygen. The oxidatively passivated char is then substantially simultaneously rehydrated and cooled to form a char having about 5–10 wt % moisture and then conveyed to a final passivation vessel wherein a process gas having about 3%–21% by volume oxygen flows through the vessel to finally passivate the rehydrated char by chemisorption of oxygen.

17 Claims, 3 Drawing Sheets

PROCESS FOR TREATING NONCAKING COAL TO FORM PASSIVATED CHAR

FIELD OF THE INVENTION

This invention relates to a process for treating noncaking coal to form passivated char. More particularly, this invention relates to a process for the successive treatment of noncaking coal to form char having suitable storage stability while retaining desirable fuel characteristics.

BACKGROUND OF THE INVENTION

The most abundant coal resources in western North America are low rank coals, including subbituminous and lignite. Many deposits of the low rank coals are relatively inexpensively mined compared to higher-rank coals in eastern North America, Australia and Europe, but their economic value is significantly reduced because they contain significant amounts of moisture and oxygen in combined form. Moisture contained within the coal results in both increased transportation costs from the coal deposit to the point of use, and decreased heat available from the coal when burned because of the heat required to evaporate the moisture. The problem generally exists in all subbituminous coals and is particularly acute with low-rank coals, which may contain from 20% to 50% moisture when mined.

A well known practice to reduce the moisture content in coal is to evaporate the moisture by low temperature heating of the coal to about 80°–150° C. The low temperature heating method, however, is disadvantageous because the resultant dried coal has a propensity for self heating and also readily reabsorbs moisture from the atmosphere to approach its previous moisture content state. Self-heating, also referred to as "autogenous" heating or pyrophoricity, is the tendency of a material to spontaneously ignite and burn upon exposure to air at ambient conditions. This self heating is related to two processes, the heat of rehydration of the dried coal or char and the chemisorption of oxygen.

Mild gasification methods, used in producing process derived fuel, also typically dry the coal before gasification to form char. The coal is dried by thermal processing using continuously flowing heated streams of oxygen-deficient gas for convective heat transfer to the coal. Similar to dried coal, it is well known that char has a propensity to self-heat when stored and shipped at atmospheric ambient conditions or when exposed to water in liquid or vapor form.

When exposed to the atmosphere, dry char rapidly adsorbs water vapor and oxygen and subsequently heats up and it ignites if not cooled. The adsorption of water vapor or oxygen and resultant oxidation of the char is manifested in an exothermic reaction. Oxygen physically adsorbs onto the surface of the coal and chemically reacts with organic molecules within the coal. This reaction can have an ultimate heat release of about 120,000 kJ per mole of oxygen. Because oxidation rates will approximately double with each 10° C. rise in temperature, the heat, if not dissipated, will promote a self-accelerating oxidation process and cause the coal temperature to rise progressively until the coal spontaneously ignites. If self-heating of the char reaches ignition temperature it is commonly referred to as "spontaneous combustion," which represents a serious hazard whenever substantial amounts of char are stockpiled or transported.

Another cause of self-heating occurs when char adsorbs water, either in liquid or vapor form. At ambient temperatures, carbon oxidation rates are generally too small to initiate the combustion of char. However, when dry coal or char is wetted by water, heat is released due to the adsorption of water onto the dry coal or char. Water vapor physically adsorbs onto the coal or char releasing the heat of vaporization which amounts to about 20,000 kJ/mole of water. Such "heat of wetting" raises the temperature of the dry coal or char to levels at which carbon oxidation occurs more rapidly. The increased oxidation rates eventually lead to spontaneous combustion. This mechanism explains why spontaneous combustion of coal commonly occurs after rain following a period of dry hot weather. The foregoing mechanism also takes effect when dry coal or char is placed on wet ground, and when wet coal is loaded onto an established, partially dried-out stockpile. In the latter cases, heating invariably begins at the interface between the wet and dry material.

Equilibrium moisture is defined by ASTM as the moisture content of a sample of coal or char when it is equilibrated with 96% relative humidity air at 30° C. It is believed that this condition is similar to that found in a stockpile of moist coal. If a stockpile of coal is above its equilibrium moisture level then it will tend to lose moisture to its surroundings, on the other hand, if it is below its equilibrium moisture level then it will tend to pick-up moisture from its surroundings.

Equilibrium moisture plays an important role in the self-heating of coal or char stock piles. If the coal or char are below their equilibrium moisture then a stockpile will tend to pick-up moisture, causing the stockpile to heat up due to the heat of rehydration. The rise in temperature will cause the rate of oxygen chemisorption to increase which will in turn cause the effected part of the stockpile to heat and to eventually self-ignite. Simply, drying low rank coals does not change the equilibrium moisture level, therefore the dried coal will tend to rehydrate back to its equilibrium moisture level releasing the heat of rehydration.

In view of the propensity of char to self-heat, it is desirable that all of the char in a stockpile is suitably treated to passivate the self heating character of the char thereby protecting the remainder of the pile from spontaneous combustion.

It is an object of the present invention to provide a process for treating noncaking coal to form char. Another object of the present invention is to provide a char having a significantly higher heating value than the coal, e.g., 8,500 Btu/lb as compared to 11,500 Btu/lb. It is a further object of the present invention to provide a char having suitable storage stability while retaining desirable fuel characteristics. As used herein the term "low end volatile components" refers to those compounds which are vaporized from about 400°–480° C. Similarly, the term "high end volatile components" refers to those compounds which are vaporized from about 480°–950° C.

SUMMARY OF THE INVENTION

Briefly, according to the invention there is provided a continuous process for the successive treatment of coal to form stable char. The process includes the sequential steps of providing a noncaking coal feed; drying the coal to remove moisture therefrom and form a dry coal; pyrolyzing the dry coal by progressively heating substantially all of the coal to a temperature sufficient to vaporize and remove low end volatile materials from the coal to form char and sufficient to mobilize at least a portion of high end volatile materials within the char and at least partially collapse micropores within the char. The char is then cooled to a temperature sufficient to demobilize the volatile materials within the at least partially collapsed micropores of the char to pyrolytically passivate the char and form a char having about 14–22 wt % high end volatiles. The char is then conveyed to a reaction vessel wherein a process gas having about 3%–21% by volume oxygen flows through the reaction vessel to oxidatively passivate the coal by chemisorption of oxygen; and then substantially simultaneously rehydrating and cooling the passivated char to form a hydrated char having about 5–10 wt % moisture. The char is then finished by evaporating the surface moisture of hydrated char with hydrated ambient air. More particularly, the char is conveyed to a final passivation vessel wherein a process gas having about 3%–21% by volume oxygen flows through the vessel to finally passivate the rehydrated char by chemisorption of oxygen.

BRIEF DESCRIPTION OF THE DRAWINGS

Further features and other objects of this invention will become clear from the following detailed description made with reference to the drawings in which.

DETAILED DESCRIPTION OF THE PREFERRED EMBODIMENTS

Figure 1:
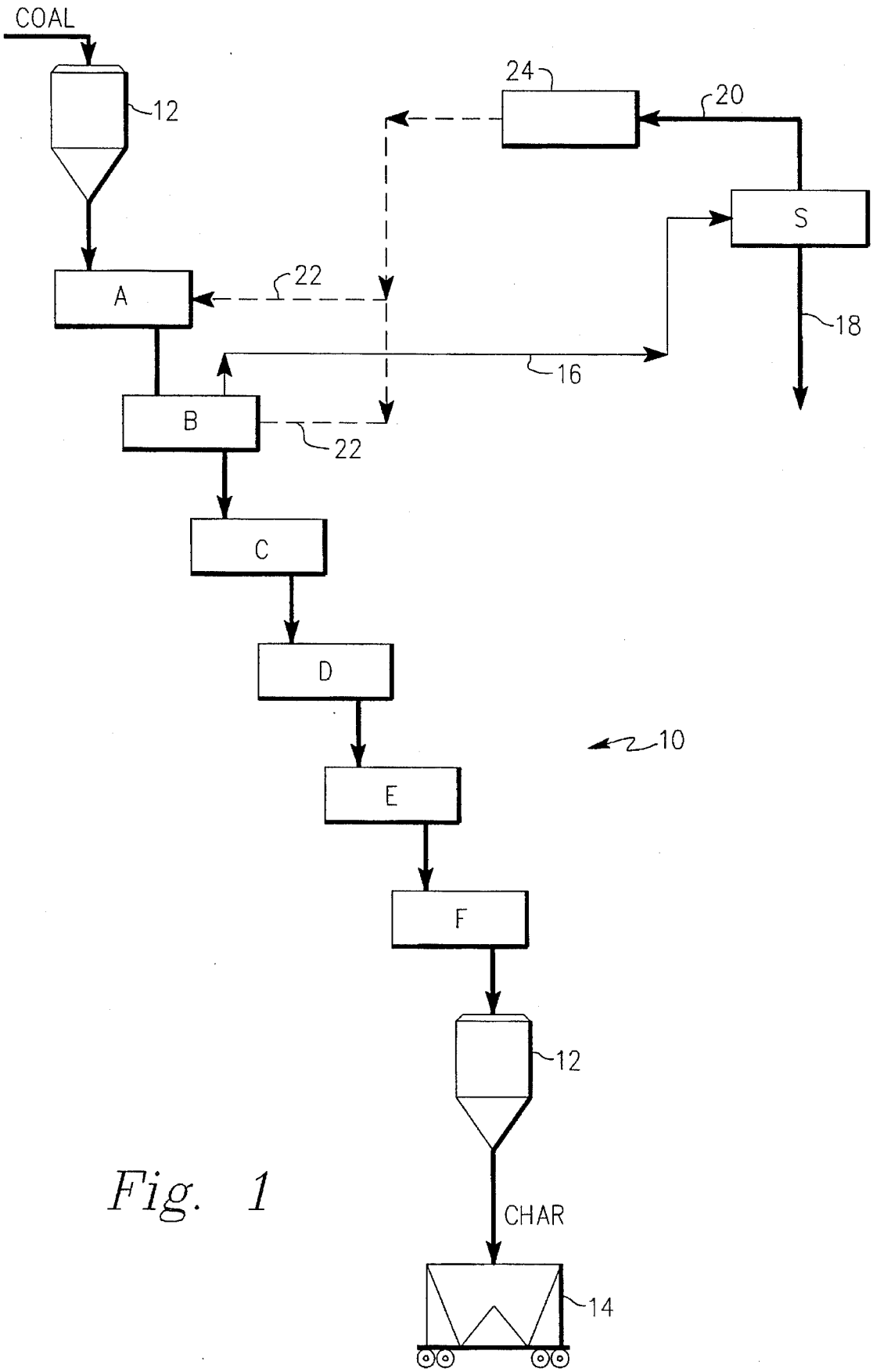
FIG. 1 is a schematic of the process of the present invention illustrating the process for the successive treatment of noncaking coal to form passivated char.

Referring to the figures wherein like reference characters represent like elements, there is shown a schematic of a process 10 for the successive treatment of noncaking, coal to form passivated char.

In considering the figures, it will be appreciated that for purposes of clarity certain details of construction are not provided in view of such details being conventional and well within the skill of the art once the invention is disclosed and explained. Reference is made to Perry and Chilton, CHEMICAL ENGINEERS' HANDBOOK, 5th Edition, McGraw Hill, New York, 1973; Kelly and Spottiswood, INTRODUCTION TO MINERAL PROCESSING, John Wiley & Sons, Inc., New York, 1982; Walas, CHEMICAL PROCESS EQUIPMENT, Selection and Design, Butterworth Publishers, Boston, 1988; Woods, PROCESS DESIGN AND ENGINEERING PRACTICE, PTR Prentice Hall, New Jersey, 1995, and to the chemical processing industry literature generally for detailed descriptions on the various apparatus and processing structures and conditions. For example, a hopper, a pyrolyzer, a dryer, piping, seals, flues, blowers and valves may be any such known commercially available components with the exception that such components may be modified as necessary by one skilled in the art to be employed in the overall process of the present invention as discussed herein. In addition, many control devices which are conventional and standard in chemical processing have been omitted for clarity of illustrating and describing the invention. For example, control valves, thermocouples, thermistors, coupled with suitable servo circuits are readily available and conventionally used for measuring and controlling temperature and process flow. For further details of equipment and process conditions for treating coal reference is made to U.S. patent application Ser. No. 08/525,235, filed Sep. 8, 1995, incorporated herein by reference.

The process 10 in accordance with the present invention is particularly suited for noncaking coal containing a high moisture content. For example, the present invention is particularly suited for a noncaking coal such as Western lignite coal containing approximately 20%–50% moisture by weight.

The noncaking coal may be conveyed through the process 10 of the present invention along a conventional continuous conveyor belt (not shown), by a skip hoist, by a vibratory conveyor, pneumatically or in any other suitable manner. For efficiency, the coal may be prepared by washing, crushing and classifying to provide coal of suitable quality, quantity and particle size. Typically, coal of a size ranging from +¼ in. to −3 in., preferably +¼ in. to −2 in., is a suitable feed for the process of the present invention.

The process 10 includes sequentially providing a coal feed to a hopper 12, drying the coal (A), pyrolyzing the coal to form char (B), quenching the char (C), oxidatively passivating the char (D), rehydrating the char (M), and then finally passivating the char (F) such that the passivated char may then be conveyed for transport via a carrier 14, and/or storage in a suitable vessel such as a hopper 12 for subsequent use as desired. It will be appreciated that because of the unique arrangement of the various process steps (A)–(F), a stable char is produced that may be economically transported.

The coal of desired size and quality is conveyed to a coal feed hopper 12 where it is metered to a dryer of a suitable type well known in the art for drying (A). The dryer heats the coal to a temperature of about 120°–260° C. to reduce the moisture content of the coal and prevent significant amounts of methane and/or carbon monoxide from being released from the coal.

The dry coal is then conveyed to a pyrolyzer for pyrolyzing (B) the coal to form char having certain desired properties, e.g. removal of remaining free moisture, lower relative sulphur content and higher relative carbon content. The pyrolyzer may be a batch type furnace or a continuous type furnace of a type well known in the art.

During pyrolysis (B), the temperature of the coal is sequentially and progressively raised to a desired maximum temperature to remove low end volatile materials and to mobilize some of the high end volatile materials. The coal typically enters the pyrolyzer at temperatures of about 149°–204° C. The coal is then progressively heated within the pyrolyzer to temperatures of about 427°–590° C. The coal is heated to a progressively higher temperature to vaporize and remove low end volatiles and then heated to achieve a desired mild gasification temperature to produce a char having about 14–22 wt % residual volatiles and a reduced equilibrium moisture content of from about 20–30 wt % to about 5–10 wt %.

The exhaust gas discharged from the pyrolyzer contains liquid oil by-product and about 5–10 wt %, generally about 5 wt % coal char fines entrained within the enriched exhaust gas 16. The enriched exhaust gas 16 is conveyed to a separator (S) wherein a process derived gaseous fuel 20 and a condensed oil product 18 may be separated from the exhaust gas 16. The process derived gaseous fuel 20 may be combusted in one or more combustor(s) 24 to produce products of combustion 22 for use in the drying and pyrolysis of the coal as described in U.S. Pat. No. 5,401,364, incorporated herein by reference.

The condensed oil product 18 from the separator (S) may be used as a low sulfur blending stock with petroleum catalytic cracker bottoms for use as steam boiler fuel or it may be used directly as a steam boiler fuel. Alternatively, the oil product 18 may be upgraded in subsequent process steps, which may include solvent extraction, and/or distillation in combination or as separate steps to produce several higher valued chemical feed stocks such as cresylic acids, paraffinic hydrocarbons, substituted catechols and coal tar pitch. In addition, the condensed oil product 18 may be extracted with suitable solvents to produce valuable chemical feed stocks which may then be distilled or the condensed oil product 18 may be first distilled, and then the distillate extracted by suitable solvents to produce valuable chemical feed stocks.

The char is pyrolytically passivated by rapidly cooling in or after the pyrolyzer to about 177° C. The char may be cooled by most any suitable means for cooling a solid material such as a plurality of coolant spray nozzles which spray a coolant such as water and the like. The char is rapidly cooled by about 100° C. in a few minutes, e.g., in about 20 minutes or less, preferably about 10 minutes or less, and most preferably about 2 minutes or less to at least partially collapse the micropores within the char to form a char having about 14–22 wt % high end volatiles.

The pyrolytically passivated char is then discharged for cooling (C) in a quench chamber of a type well known in the art. The char may be cooled with most any suitable medium such as water. The cooled char is then metered from the quench chamber into an oxidative passivation unit wherein the char is oxidatively passivated (D). In a preferred embodiment, the char enters the oxidative passivation unit at a temperature of about 150°–200° C., preferably about 160° C. The oxidative passivation unit may be most any type of bed or sealed vessel for handling and conveying solid particles and contacting of the solid particles with a process gas in a cross flow system that is isolated from the surrounding ambient air.

In the oxidative passivation unit, the char particles undergo intensive intermixing with a process gas. The properties of the process gas are controlled to balance the energy release rate with the energy absorption rate. This balance of energy exchange deters an uncontrolled reaction in the oxidative passivation unit which may lead to unwanted combustion. This energy exchange is referred to as "energy compensation" by those familiar with the art.

In a preferred embodiment, the process gas enters the oxidative passivation unit at a temperature of about 154°–188° C., preferably about 157° C., containing about 3%–21% volume oxygen. The volume percent of oxygen of the process gas is inversely proportional to the temperature of the process gas. As the temperature of the process gas decreases the volume percent of oxygen is increased. At a temperature of 188° C. the process gas contains about 3% by volume oxygen and at a temperature of about 82° C. the process gas contains about 21% by volume oxygen.

The solid char particles undergo intensive intermixing as the process gas surrounds each particle transferring heat directly and facilitating an oxidative chemical reaction between the process gas and the char particles. More particularly, a portion of the oxygen in the process gas reacts with the char and chemisorbs to the char releasing heat and restraining the char from spontaneously igniting. As used herein the term "chemisorbed" refers to the formation of a bond between a surface carbon atom or a carbon atom in a partially collapsed pore of the char and an oxygen atom in contact with the char. It will be appreciated that the amount of oxygen chemisorbed to the char depends on the temperature, contact time with char and initial oxygen concentration of the process gas.

After the char is retained for a controlled predetermined retention time in the oxidative passivation unit the char is discharged at a temperature of about 175°–200° C., preferably about 182° C. for further processing to an energy compensated rehydration cooler of a type well known in the art to substantially simultaneously rehydrate and cool the char (E).

The rehydrated char is cooled to about 38° C. and contains about 5–10 wt % moisture, preferably about 8 wt % moisture. The time that the char is present in the cooler is referred to as char retention time. It is preferred to control the retention time to maximize char cooling yet minimize rehydration processing time. In a preferred embodiment, the char retention time ranges from about 10–20 minutes. The char is rehydrated using both direct and indirect contact of water spray.

It will be appreciated that when pyrolyzed char is rehydrated an exothermic reaction occurs which produces heat energy. The rehydration process is self-limiting in that as the char temperature rises due to rehydration, the water adsorbed by the char evaporates thus reducing the moisture content of the char. Therefore, if the heat created by rehydration is either not compensated for or removed from the char, the rate of rehydration and the probability of obtaining equilibrium moisture levels within the char making the char safe for transport is diminished. The increased char temperatures caused by rehydration can result in non-uniform rehydration causing the formation of random hot spots on the char, which in turn can react with atmospheric oxygen to further the self heating effect. Therefore, to maximize the moisture levels of the char during rehydration and to minimize processing time and formation of hot spots the char must be precisely cooled during rehydration.

It has been found that rehydration of the char tends to partially reactivate the char. Accordingly, the rehydrated char must be finished in a final passivation vessel to satisfy the oxygen appetite recovered in the rehydration step. The finishing step (F) must be performed under conditions mild enough to prevent the char from drying. The char is finished by oxidizing the char in a moist air stream at near ambient conditions. In a preferred embodiment, a process gas having about 3–21% by volume oxygen and 4–12 wt % moisture at a temperature of about 18°–43° C., preferably about 27° C., flows through the final passivation vessel to further passivate the rehydrated char by chemisorption of oxygen. Moisture is added to the process gas to increase the process gas relative humidity to about 90% to prevent the char from drying. Because the final passivation temperature is low, the oxidation rates are slow making a long residence time in the passivation vessel necessary.

Figure 2:
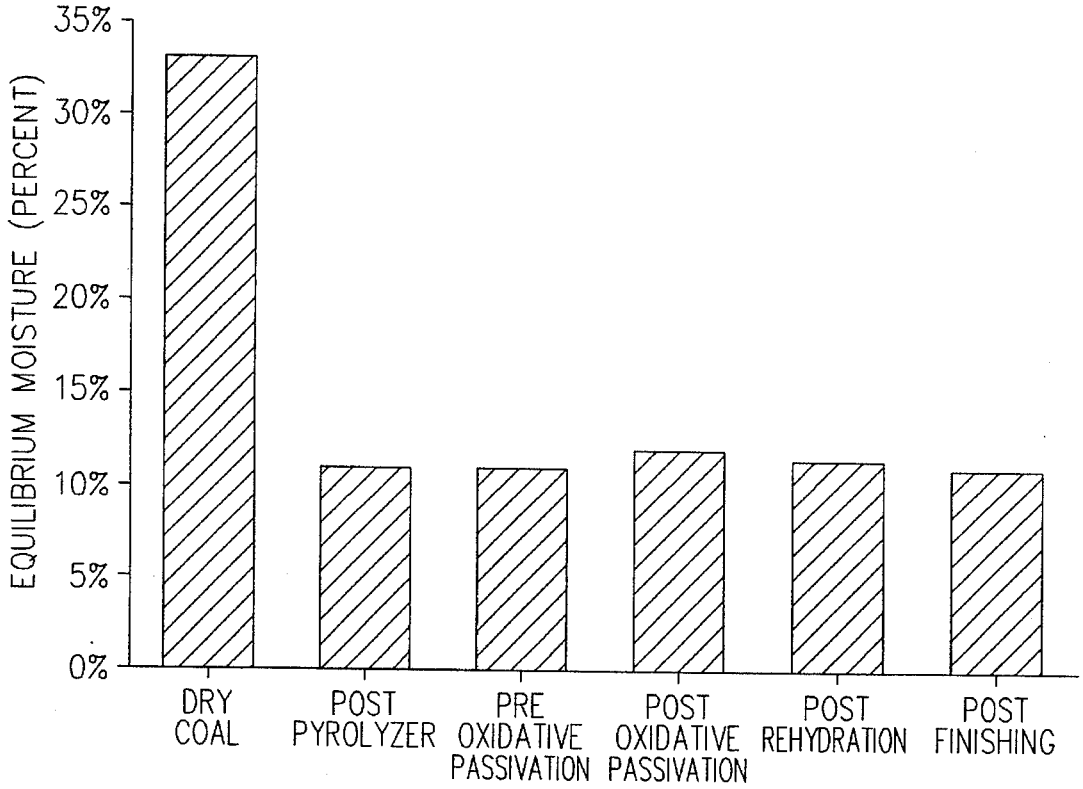
FIG. 2 is a bar graph of the equilibrium moisture volume percent of dry coal and coal processed at various stages in accordance with the present invention.
Figure 3:
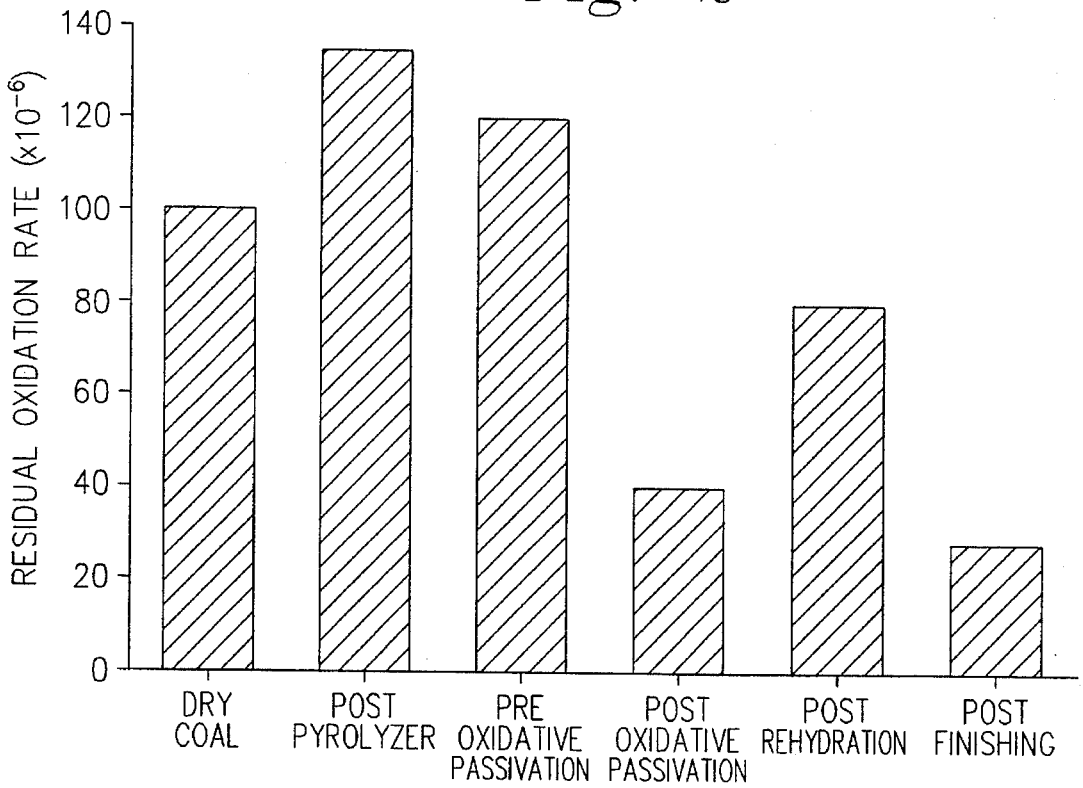
FIG. 3 is a bar graph of the residual oxidation rate of dry coal and coal processed at various stages in accordance with the present invention.
Figure 4:
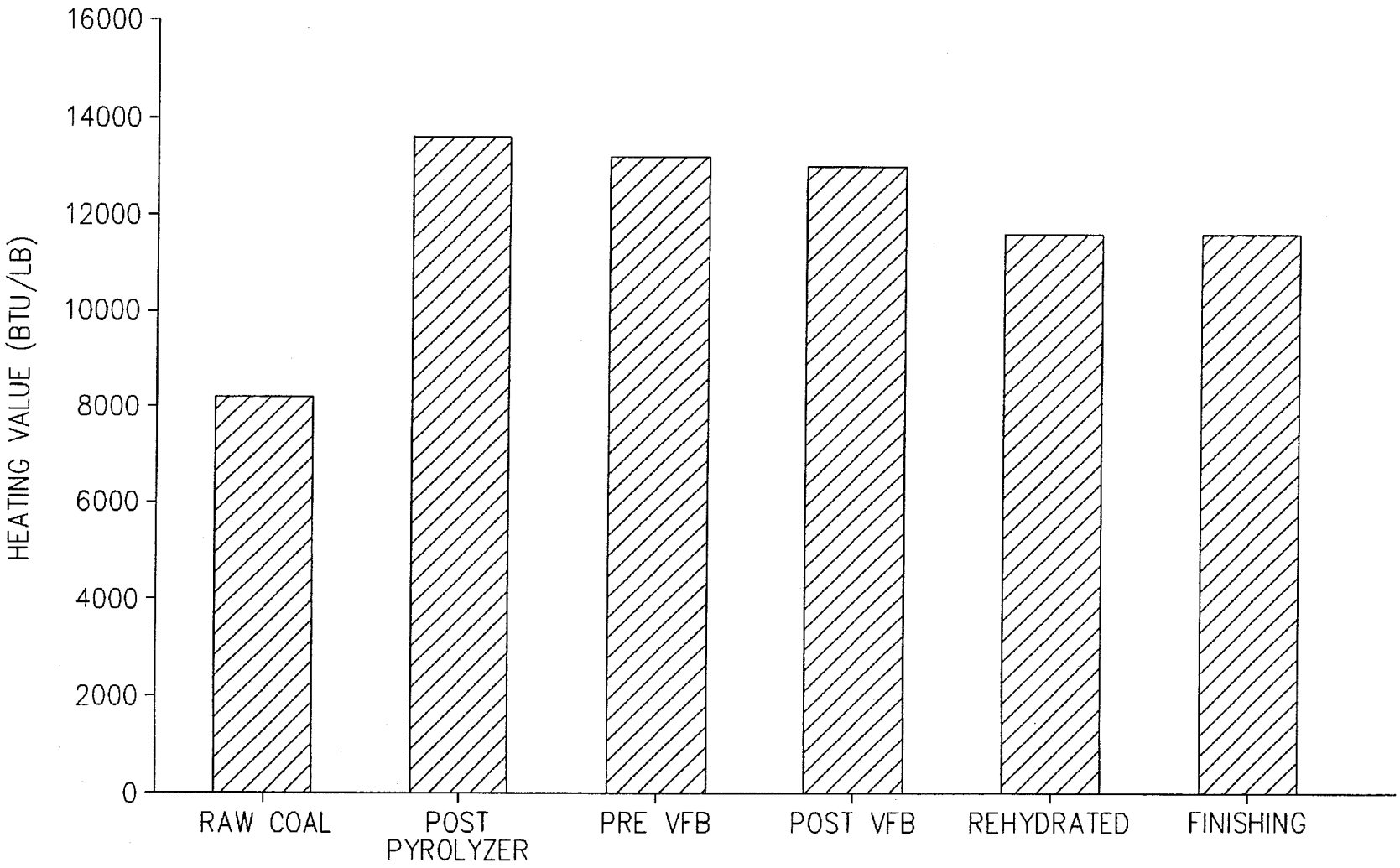
FIG. 4 is a bar graph of the heat content of the coal processed in accordance with the present invention.

A comparison of the equilibrium moisture content of dry coal, before and after treatment in accordance with the present invention is shown in FIG. 2. As shown in FIG. 2, the equilibrium moisture level of dry coal is about 32 wt % at about 90% relative humidity. After the coal has been treated in the pyrolyzer and the oxidative passivation unit the equilibrium moisture level is about 10 wt % at about 90% relative humidity and remains substantially constant throughout the remainder of the process thereby substantially increasing the calorific value of the char per unit weight (see FIG. 4). In addition, it will be appreciated that the degree of passivation of the char is related to the residual oxidation rate of the char. As shown in FIG. 3, the char treated in accordance with the process of the present invention has a substantial reduction in residual oxidation, i.e. is passivated. It will be appreciated that FIGS. 2–4 show actual results as practiced without the pyrolytic passivation step.

Having described presently preferred embodiments of the invention, it is to be understood that it may be otherwise embodied within the scope of the appended claims.

What is claimed is:

1. A continuous process for treating noncaking coal to form stable char, the process comprising the sequential steps of:

a) providing a noncaking coal feed;

b) drying the coal to remove moisture therefrom and form a dry coal;

c) pyrolyzing the dry coal by progressively heating substantially all of the coal to a temperature sufficient to vaporize and remove low end volatile materials from the coal to form char and sufficient to mobilize at least a portion of high end volatile materials within the char and at least partially collapse micropores within the char;

d) cooling the char to a temperature sufficient to demobilize the volatile materials within the at least partially collapsed micropores of the char to pyrolytically passivate the char and form a char having about 14–22 wt % high end volatiles;

e) oxidatively passivating the char of step d) with a process gas having about 3%–21% by volume oxygen by chemisorption of oxygen;

f) substantially simultaneously rehydrating and cooling the char to form a char having about 5–10 wt % moisture; and g) finally passivating the char of step f) with a process gas having about 3%–21% by volume oxygen by chemisorption of oxygen to form stable char.

2. The process of claim 1 wherein the coal is dried at a temperature of about 120°–260° C.

3. The process of claim 2 wherein the coal is pyrolyzed to temperatures of about 427°–590° C.

4. The process of claim 3 wherein the char of step c) has a reduced equilibrium moisture content of from about 20–30 wt % to about 5–10 wt %.

5. The process of claim 4 wherein the char is cooled after pyrolyzing to about 177° C.

6. The process of claim 4 wherein the char is rapidly cooled by about 100° C. in about 20 minutes or less to at least partially collapse the micropores within the char.

7. The process of claim 1 wherein the char of step d) is cooled to a temperature of about 150°–200° C.

8. The process of claim 1 wherein the char of step e) is at a temperature of about 175°–200° C.

9. The process of claim 1 wherein the char is rehydrated at a temperature of about 38° C. and contains about 5–10 wt % moisture.

10. The process of claim 1 wherein the char is rehydrated using both direct and indirect contact of a water spray.

11. The process of claim 1 wherein the char is finally passivated by oxidizing the char in a process gas having about 3–21% by volume oxygen, 4–12 wt % moisture at a temperature of about 18°–43° C.

12. The process of claim 1 wherein the char is finally passivated by oxidizing the char in a process gas having about 3–21% by volume oxygen and about 90% relative humidity.

13. A continuous process for treating noncaking coal to form stable char, the process comprising the sequential steps of:

a) providing a noncaking coal feed:

b) drying the coal to remove moisture therefrom and form a dry coal;

c) pyrolyzing the dry coal by progressively heating substantially all of the coal to a temperature sufficient to vaporize and remove low end volatile materials from the coal to form char having an equilibrium moisture content of from about 20–30 wt % to about 5–10 wt % and sufficient to mobilize at least a portion of high end volatile materials within the char and at least partially collapse micropores within the char;

d) cooling the char to a temperature sufficient to demobilize the volatile materials within the at least partially collapsed micropores of the char to pyrolytically passivate the char and form a char having about 14–22 wt % high end volatiles;

e) oxidatively passivating the char of step d) with a process gas having about 3%–21% by volume oxygen by chemisorption of oxygen;

f) substantially simultaneously rehydrating and cooling the char to form a char having about 5–10 wt % moisture; and g) finally passivating the char of step f) with a process gas having about 3%–21% by volume oxygen and about 90% relative humidity by chemisorption of oxygen to form stable char.

14. The process of claim 13 wherein the coal is dried at a temperature of about 120°–260° C.

15. The process of claim 13 wherein the coal is pyrolyzed to temperatures of about 427°–590° C.

16. The process of claim 13 wherein the char is cooled after pyrolyzing to about 177° C.

17. The process of claim 13 wherein the char is rapidly cooled by about 100° C. in about 20 minutes or less to at least partially collapse the micropores within the char.

* * * * *